US005975317A

United States Patent [19]

Roebling

[11] Patent Number: 5,975,317

[45] Date of Patent: Nov. 2, 1999

[54] COLLAPSIBLE CARD DISPLAY

[76] Inventor: W. R. Roebling, P.O. Box 8834, Longboat Key, Fla. 34228

[21] Appl. No.: 08/977,823

[22] Filed: Nov. 25, 1997

[51] Int. Cl.[6] ..... A47F 5/00

[52] U.S. Cl. ..... 211/45; 211/196; 40/124.4

[58] Field of Search ..... 211/163, 45, 205, 211/196, 118, 47; 40/124, 124.4; 248/205.3

[56] References Cited

U.S. PATENT DOCUMENTS

| | | | |
|---|---|---|---|
| 2,447,856 | 8/1948 | Hazelton | 40/124 |
| 2,503,359 | 4/1950 | Smith | 211/196 X |
| 2,841,901 | 7/1958 | Maple | 40/124 X |
| 2,865,122 | 12/1958 | Clawson | 40/124 X |
| 2,886,184 | 5/1959 | Crone | 40/124 X |
| 2,913,843 | 11/1959 | Wittick | 40/124 X |
| 2,939,234 | 6/1960 | Hill | 40/124 |
| 2,951,303 | 9/1960 | Hovlid | 40/124 X |
| 3,263,355 | 8/1966 | March | 40/124.4 |
| 3,327,419 | 6/1967 | Stanos | 40/124 |
| 3,581,419 | 6/1971 | McCracken | 40/124 |
| 3,593,768 | 7/1971 | Taub | 150/49 |
| 3,594,948 | 7/1971 | Luchsinger | 46/119 |
| 3,599,360 | 8/1971 | Lappo | 40/124.4 |
| 4,010,698 | 3/1977 | Taub | 108/111 |
| 4,071,969 | 2/1978 | Tonhauser | 40/610 |
| 4,303,163 | 12/1981 | Henry | 211/133 |
| 4,310,137 | 1/1982 | Frye | 248/205.3 X |
| 4,746,022 | 5/1988 | Benham | 211/196 X |
| 4,895,261 | 1/1990 | Yacobian | 211/196 |
| 4,968,541 | 11/1990 | McCrory | 211/196 X |
| 4,993,560 | 2/1991 | Jaffe | 211/45 |
| 5,038,943 | 8/1991 | Reinke | 211/59.1 |
| 5,103,970 | 4/1992 | Nielson et al. | 206/45.14 |
| 5,242,062 | 9/1993 | Engravalle | 211/45 |
| 5,322,172 | 6/1994 | Maglione | 211/132 |
| 5,336,536 | 8/1994 | Oberzan | 211/196 X |
| 5,413,825 | 5/1995 | Chaikin | 211/196 X |
| 5,416,997 | 5/1995 | Dyment et al. | 40/610 |
| 5,462,782 | 10/1995 | Su | 248/205.3 X |
| 5,522,574 | 6/1996 | Maglione | 248/174 |

*Primary Examiner*—Robert W. Gibson, Jr.
*Attorney, Agent, or Firm*—Stein, Schifino & Van Der Wall

[57] ABSTRACT

A collapsible display device for displaying cards comprising of a base, a vertical support member extending vertically from the base, an array of shelves spaced longitudinally along the length of the vertical support member, and a securing means for retaining the cards on the display device. The array of shelves are supported by the vertical support member while the display device is in the expanded position. In the preferred embodiment, the securing means is a plurality of apertures disposed in the array of shelves for receiving a portion of the cards and so that the remainder of the card is visually available. In an alternative embodiment, a serpentine shelf orbits about the vertical support member from top to bottom. The display device of the present invention collapses so that the shelves are in a compact and flat condition.

8 Claims, 8 Drawing Sheets

COLLAPSIBLE CARD DISPLAY

BACKGROUND OF THE INVENTION

1. Field of the Invention

The present invention relates to collapsible displays. This invention more particularly pertains to a collapsible tree shaped display device for displaying cards for sentimental and other occasions such as Christmas.

2. Description of the Background Art

Presently, most commercially available card displays are permanent fixtures that typically require large amounts of space for the presentation of cards. Also, these known displays are the property of the particular storekeeper. Smaller or more portable card displays are not aesthetically designed for either commercial or home use. Thus, until now, only card stores could focus on the displaying of cards.

In response to the realized inadequacies of these earlier known card displays, it became clear that there is a need for a collapsible card display which has been aesthetically designed to resemble a tree. With the present invention, even stores which do not specialize in the selling of cards, may instantly have a tree like display capable of being positioned anywhere in the store. The card display of the present invention may be strategically located in a store to attract the consumer's attention. On the other hand, the card display of the present invention may be moved about a store to multiple locations. Moreover, the present invention allows storekeepers to have a card display set up for only those times, such as holidays, which he desires. The remainder of the time, the card display can be collapsed and stored until another holiday.

In addition, the card display of the present invention may be used by consumers to display cards in their homes. For example, during Christmas time, cards received from relatives and friends could be positioned on the card display of the present invention in order to provide an aesthetically pleasing display of the cards that were received for Christmas. Further, at the end of the holiday, the card display of the present invention could be stripped, collapsed and conveniently stored for use for the next occasion.

Therefore, the principal object of this invention is to provide an improvement that overcomes the aforementioned inadequacies of the prior art devices and provides an improvement that is a significant contribution to the advancement of card display devices.

Another object of this invention is to provide a new and improved collapsible display device that has all the advantages and none of the disadvantages of the earlier card displays.

Still another objective of the present invention is to provide a collapsible card display that is easily manufactured.

Yet another objective of the present invention is to provide a card display that is easily sold in conjunction with cards.

Still a further objective of the present invention is to provide an aesthetically pleasing tree shaped design for card display.

Yet a further objective is to provide a collapsible display device for displaying cards comprising a base; a vertical support member having a first and a second end, said first end coupled to said base and said vertical support member extending vertically from said base; an array of longitudinally extensible shelves spaced longitudinally along the length of said vertical support member and carried thereby, said array of shelves being longitudinally collapsible to a position where said array of shelves are substantially level with one another; and securing means for retaining the cards on the display device, said securing means disposed upon said array of shelves such that the cards are displayed in a uniform manner from about the display device.

A further objective is to provide a collapsible display device for displaying cards comprising a base; a vertical support member having a first and a second end, the first end coupled to the base and the vertical support member extending vertically from the base; a serpentine shelf orbiting about the vertical support member, the serpentine shelf having a first end and a second end, the second end of the serpentine shelf coupled to the second end of the vertical support member and the first end of the serpentine shelf coupled to the base; and securing means for retaining the cards on the display device, the securing means disposed upon the serpentine shelf such that the cards are displayed in a uniform manner from about the display device.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The present invention is defined by the appended claims with the specific embodiment shown in the attached drawings. The present invention is directed to a device that provides an aesthetically pleasing tree like display for displaying cards in stores or in homes. Moreover, the present invention is directed towards replacing the known large displays or providing consumers with a mobile and collapsible display for cards. For the purpose of summarizing the invention, the invention comprises of a base, a vertical support member coupled to the base, and an array of longitudinally extensible shelves spaced longitudinally along the length of the vertical support member. In an alternative embodiment, the collapsible display comprises of a serpentine shelf orbiting or translating about the vertical support member. The serpentine shelf is coupled to the top of the vertical support member and, as the serpentine shelf gets closer to the stand at the bottom, the radius gradually increases.

An important feature of the present invention is that the card display provides an aesthetically pleasing tree like display for displaying cards in stores or in homes and is collapsible for easy storage and movement. The present invention is collapsible because of the amount which the shelves extend outward from the vertical support member increases as the shelves get closer to the bottom of the display device. In other words, the shelves collapse to fit within one another. In addition, the shelves are designed to resemble a tree like structure to provide an aesthetically pleasing appearance. Therefore, it can be readily seen that the present invention can easily be stored or moved within a store or home with a tree like appearance for displaying cards. Thus, a collapsible card display of the present invention would be greatly appreciated.

The foregoing has outlined rather broadly, the more pertinent and important features of the present invention. The detailed description of the invention that follows is offered so that the present contribution to the art can be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more succinct understanding of the nature and objects of the present invention, reference should be directed to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
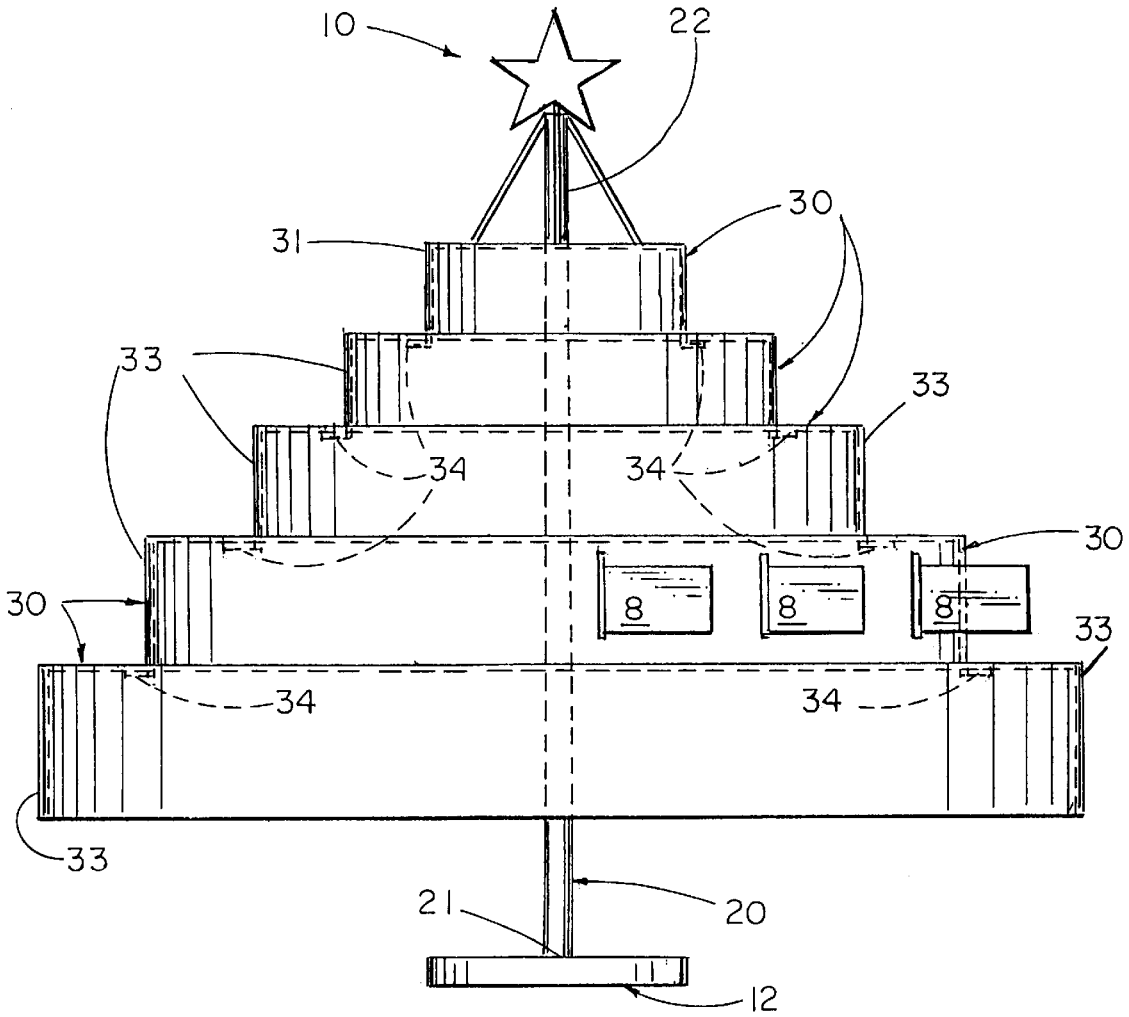
FIG. 1 is an elevated front view of one embodiment of the present invention wherein the lower shelves are supported by a flange on the side wall of the shelf immediately above.
Figure 14A:
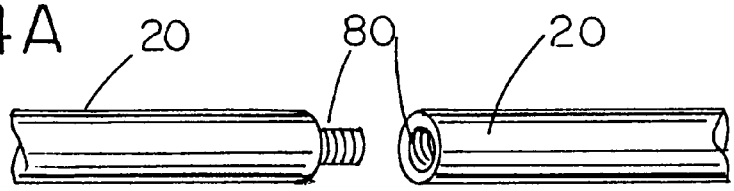
FIG. 14A illustrates the vertical support member having supports capable of being threaded together.
Figure 14B:
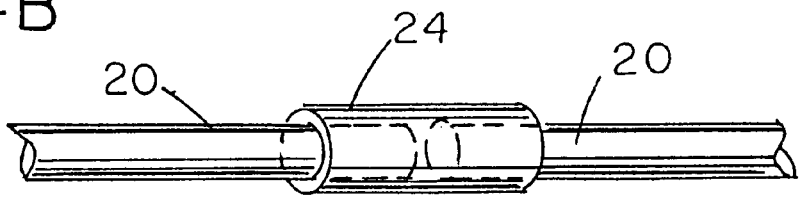
FIG. 14B illustrates the vertical support member having supports coupled together with a coupling sleeve.

With reference to the drawings, and in particular to FIG. 1 thereof, a new and improved collapsible display device embodying the principles and concepts of the present invention and generally designated by the reference number 10 will be described. As shown in FIG. 1, the base 12 is coupled to the first end 21 of the vertical support member 20 which extends vertically from the base 12. An array of longitudinally extensible shelves 30 are spaced longitudinally along the length of the vertical support member 20. In the preferred embodiment, the array of shelves 30 is cylindrical. The vertical support member 20 carries the array of shelves 30 when the display device 10 is in the expanded position. The array of shelves 30 collapses to a position so that the array of shelves 30 are substantially level with one another after the vertical support member 20 is removed. The support member 20 preferably brakes down into smaller components as shown in FIGS. 14*a* and 14*b*. To attain the support member's 20 full length, it may be assembled by joining the threadedly engaging and detachable ends 80. Alternatively, a coupling sleeve 24 as shown in FIG. 14*b* may be used to assemble the vertical support member 20.

The present invention further comprises of a securing means 40 for retaining the cards 8 on the display device 10. The securing means 40 is disposed upon the array of shelves 30 such that the cards 8 are displayed in a uniform manner from about the display device 10.

Figure 2:
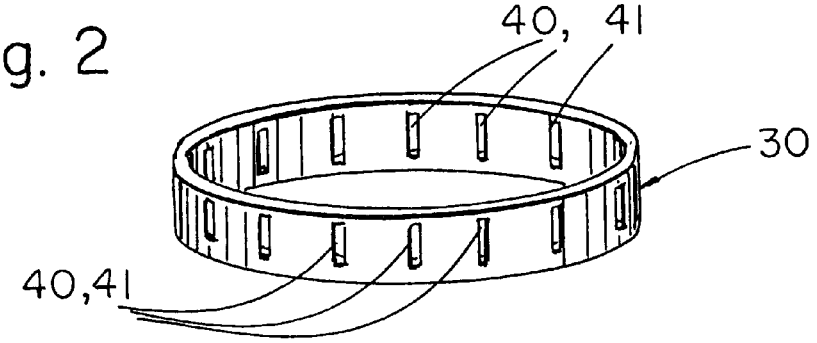
FIG. 2 illustrates a plurality of vertical apertures in a shelf for securing the cards.
Figure 3:
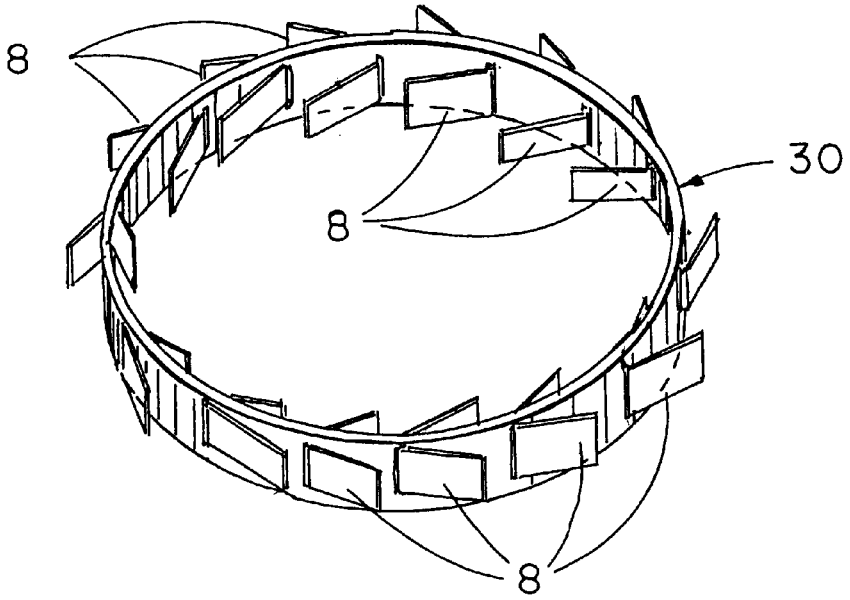
FIG. 3 illustrates the cards disposed in the plurality of apertures as shown in FIG. 2.
Figure 4:
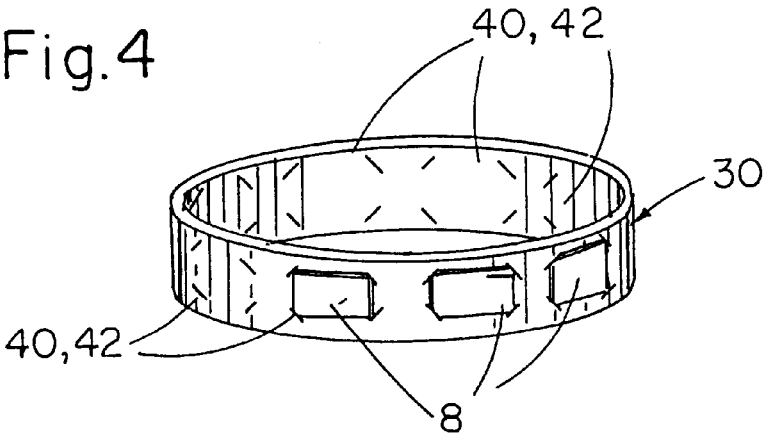
FIG. 4 illustrates a plurality of slanted apertures in a shelf for securing cards.
Figure 10:
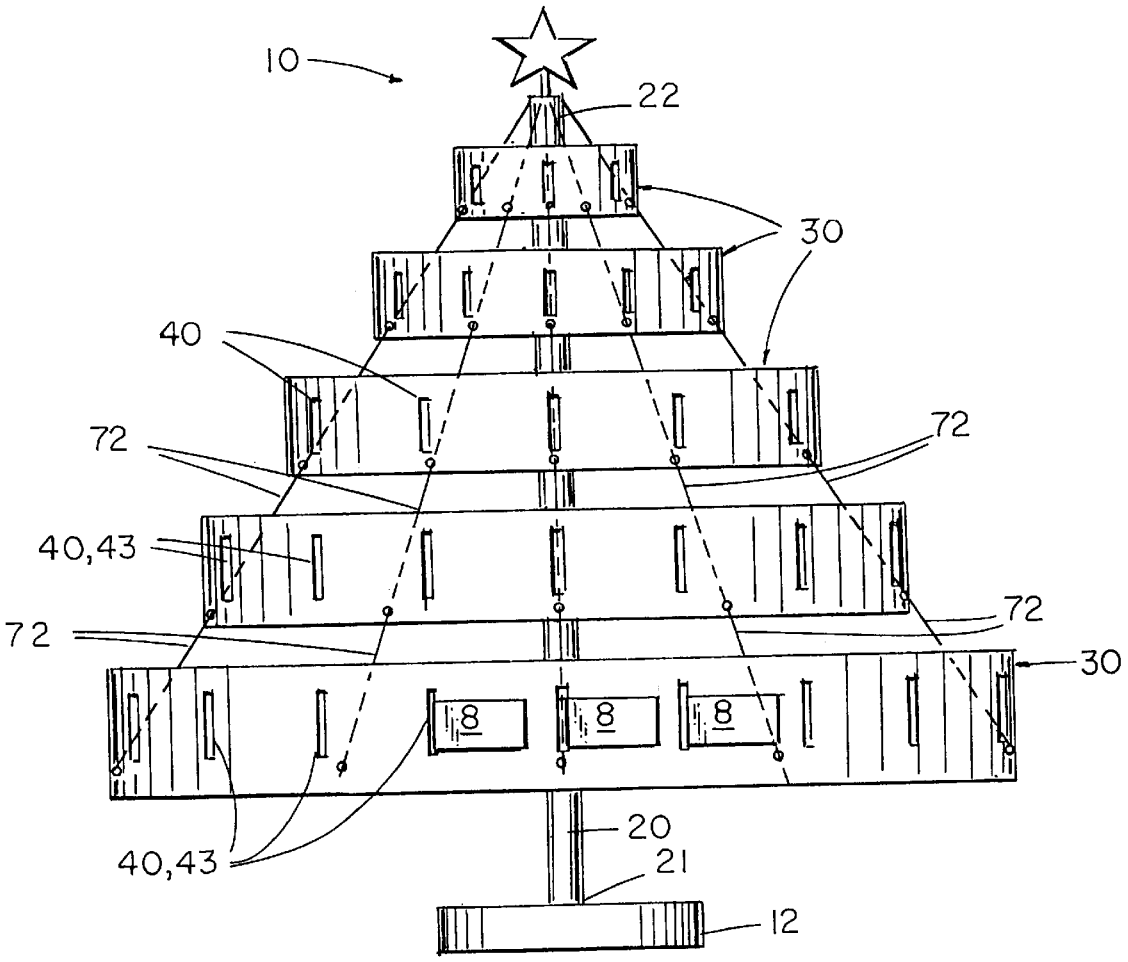
FIG. 10 is a front view of an alternative embodiment of the present invention wherein the shelves are supported by guylines and the cards are secured to the array of shelves with adhesive.

In one embodiment of the present invention, the securing means 40 is a plurality of vertical apertures 40 as shown in FIG. 2. In this embodiment, the back portion of the card 8 is placed through the aperture 41 so that the front of the card 8 is visible to the consumer as shown in FIG. 3. Alternatively, the securing means 40 may be a plurality of slanted apertures 42 as shown in FIG. 4. In this embodiment, the corners of the card 8 are placed through apertures 42 to thereby retain the card 8 on the display devise 10. In another alternative embodiment, the securing means 40 is a plurality of means for adhering 43 as shown in FIG. 10. Adhesive 43 is disposed upon the shelves 30 and is of the type which allows the consumer to remove or detach the card 8 from the display device 10 without damaging or blemishing the card 8.

Figure 11:
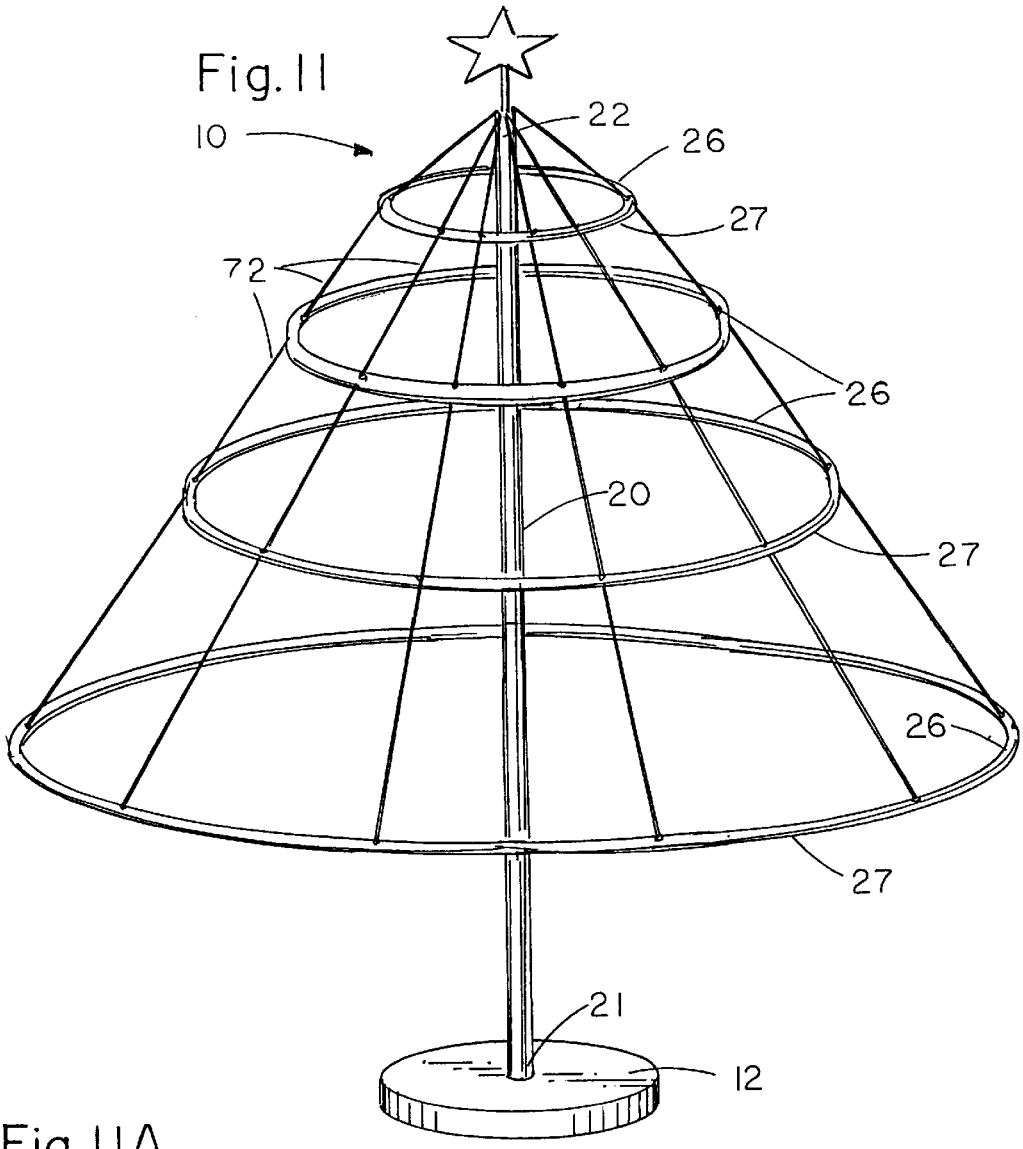
FIG. 11 is a front view of one embodiment of the present invention having an array of tubular hoop rings supported by guylines.
Figure 11A:
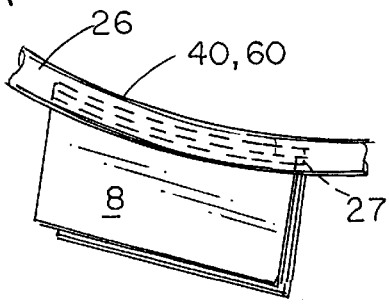
FIG. 11A is a detailed drawing of a hoop ring section employing a friction groove which is cut into the bottom of the hoop ring to secure the cards.
Figure 11B:
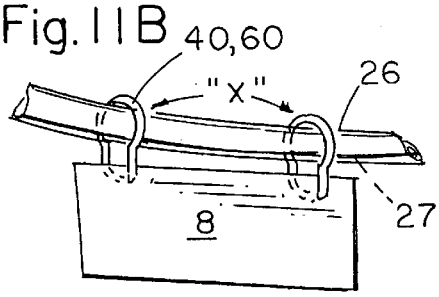
FIG. 11B is a detailed drawing of the hoop ring section employing ring clips to secure the cards.
Figure 11C:
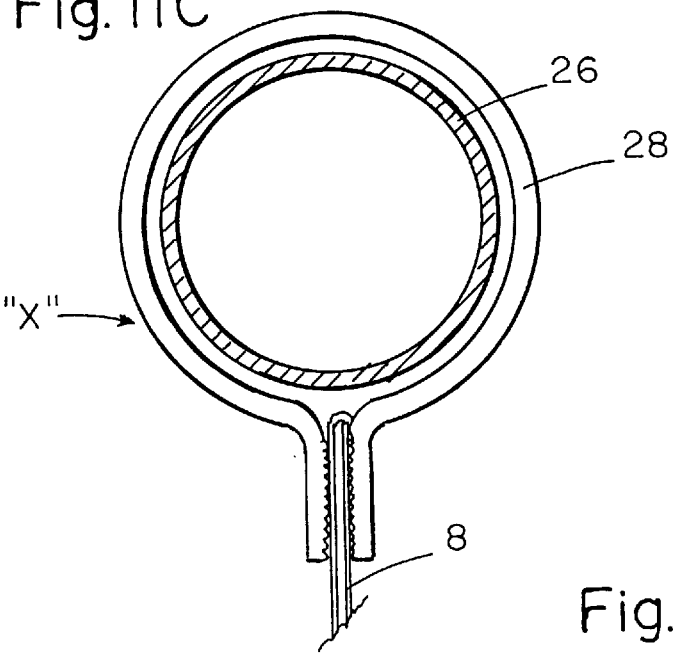
FIG. 11C is a detailed cross section of the hoop ring holding the card through the use of the ring clips.
Figure 11D:
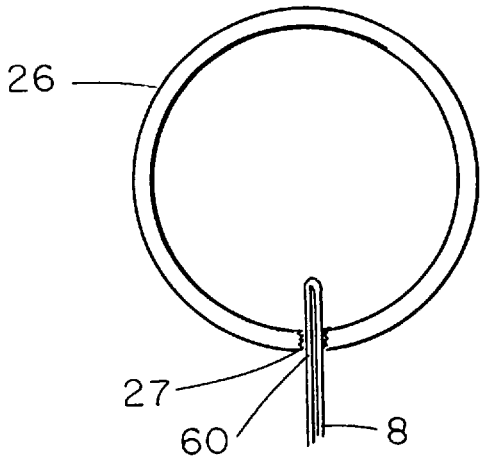
FIG. 11D is a detailed cross section of the hoop ring holding a card through the use of the friction groove.
Figure 12:
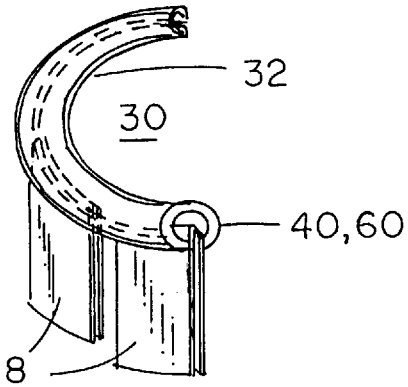
FIG. 12 is a detailed illustration of the embodiment of the present invention shown in FIG. 11D wherein the cards are suspended from the tubes by inserting them into grooves cut into the bottom edge of the tubular hoop rings.
Figure 13:
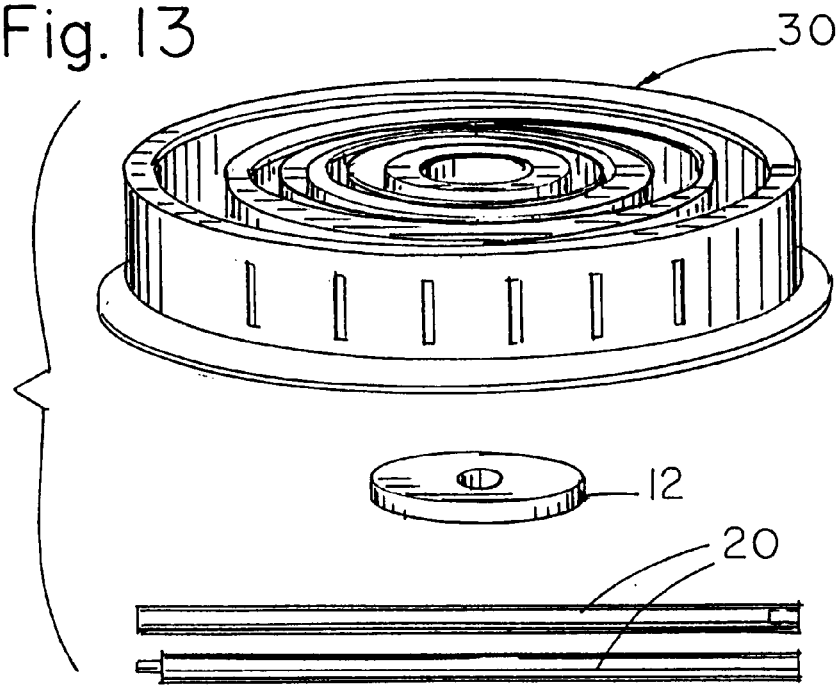
FIG. 13 illustrates one version of the present invention wherein the display is collapsed and the stand and vertical support are disassembled.

FIGS. 11A and 11D illustrate another alternative embodiment of the securing means 40. The securing means 40 is a retaining friction groove 60. The retaining groove 60 is located on the lower edge 27 of each of the tubular hoop rings 26. The retaining groove 60 retains the cards 8 upon the display device 10 by pinching the cards 8. It is preferred in this embodiment that the retaining groove 60 be incorporated into the lower edge 27 of each tubular hoop ring 26.

FIGS. 11B and 11C illustrate yet another alternative embodiment of the securing means 40. The securing means 40 is a series of retaining clips 28. The retaining clips 28 are positioned over each of the tubular hoop rings 26. The retaining clips 28 retains the cards 8 upon the display device 10 by pinching the cards 8.

In the preferred embodiment of the present invention, the upper most shelf 31 of the array of shelves 30 is coupled to the second end 22 of the vertical support member 20. Each subsequent lower shelf beneath the upper most shelf 31 is then supported by one of the shelves immediately above. One way of accomplishing this is where each shelf of the array of shelves 30 has a side wall 33 about the periphery of each shelf. The side wall 33 is radially spaced from the vertical support member 20. Also, each side wall 33 includes a flange 34 extending radially outward from the side wall 33. It is preferred that the flanges 34 be parallel misaligned with each shelf 30 immediately below. This allows the shelf 30 immediately below to be supported by the flange 34 of the shelf 30 immediately above while the display is raised into the extended position. This is best illustrated in FIG. 1.

Figure 5:
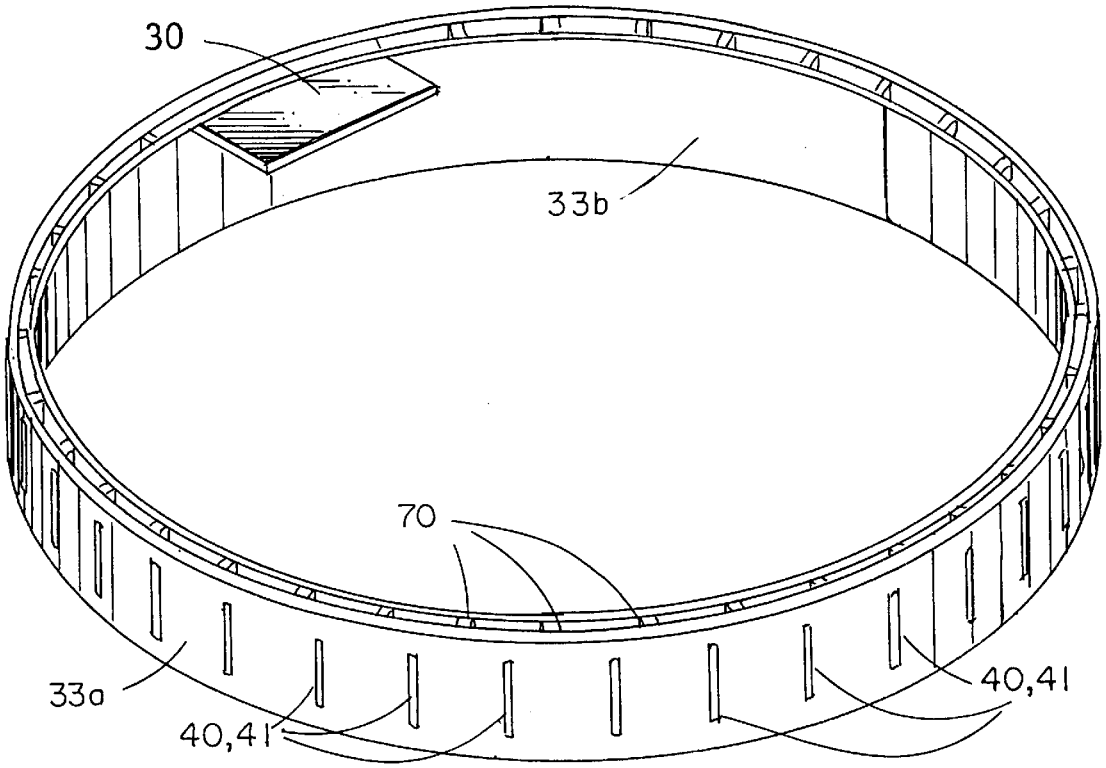
FIG. 5 is an elevated perspective view of one embodiment of the present invention having inner and outer side walls displaced from one another with a spacer there between to define a card pocket.
Figure 6:
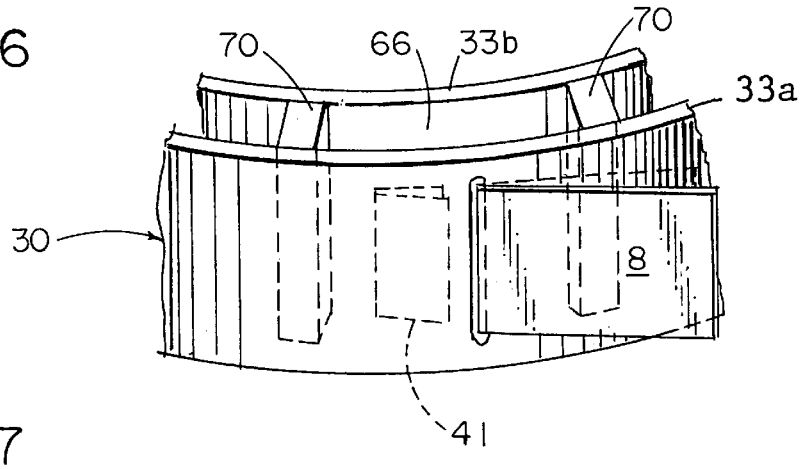
FIG. 6 is a detailed illustration of one embodiment of the inner and outer side walls displaced by a spacer to define a card pocket.
Figure 7:
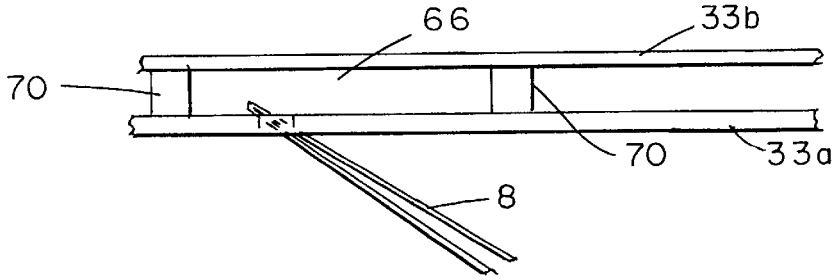
FIG. 7 is a top view of one embodiment of the card pocket.

FIGS. 5 and 6 illustrate another alternative embodiment of the present invention. Each shelf of the array of shelves 30 comprises of parallel outer and inner side walls 33*a* and 33*b* about the periphery of each shelf. The outer and inner side walls 33*a* and 33*b* are radially spaced from the vertical support member 20. The outer and inner side walls 33*a* and 33*b* are displaced from one another to define a card pocket 66 for receiving the card 8. As best seen in FIG. 6, the outer and inner side walls 33*a* and 33*b* are coupled to one another with a spacer 70. Thus, a card 8 may be placed though an aperture 41 so that the front of the card 8 remains outside the aperture 41 and extends from the shelves 30.

Another way of supporting the lower shelves from the upper most shelf 31 of the array of shelves 30 is as shown in FIGS. 10 and 11. The shelves of the array may be coupled to one another via guylines 72 such as rope, string, rod, wire or other suitable material. Separate guylines 72 may be coupled between each pair of adjacent shelves. Alternatively, single guylines 72 may be used to couple the entire array of shelves 30 from top to bottom.

Figure 8:
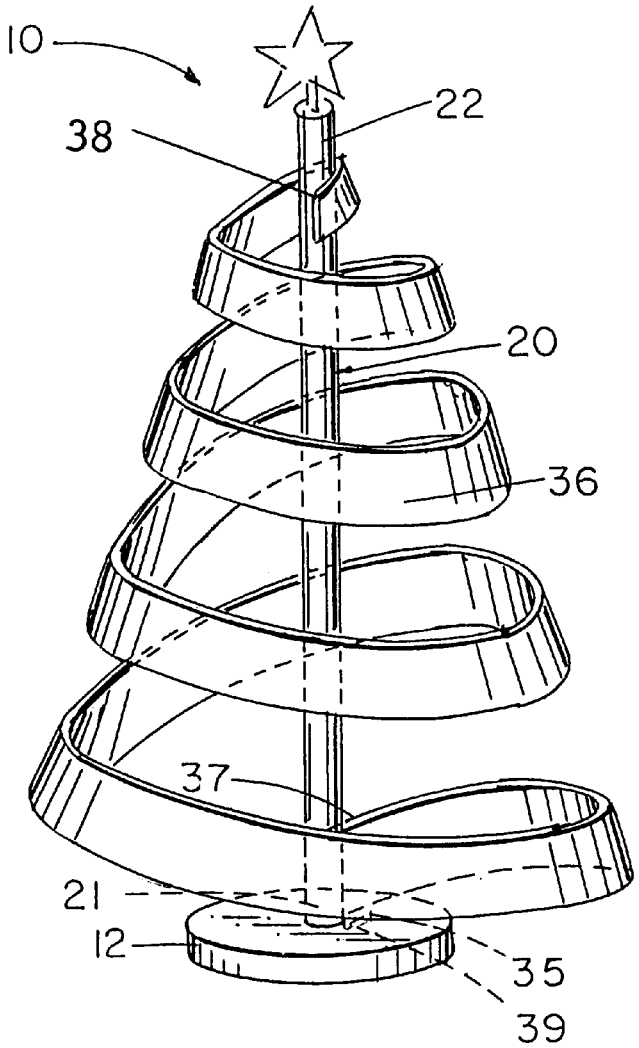
FIG. 8 is a front view of one embodiment of the present invention wherein a serpentine shelf orbits about the vertical support member.
Figure 9:
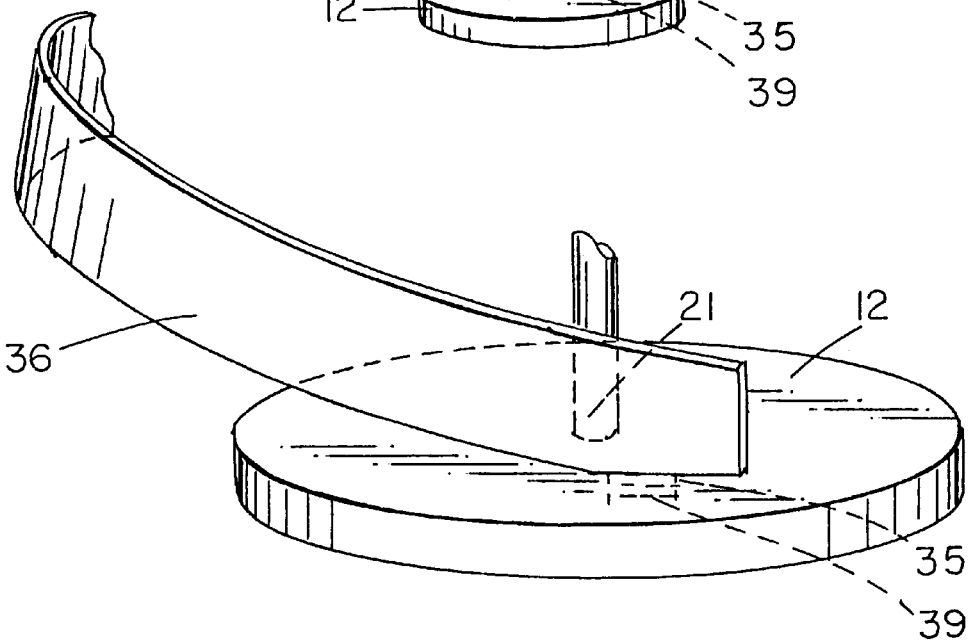
FIG. 9 is a detailed front view of the serpentine shelf of FIG. 8 coupled to the base.

FIGS. 8 and 9 illustrate another alternative embodiment of the present invention. In this embodiment, a serpentine shelf 36 orbits about the vertical support member 20. The first end 37 of the serpentine shelf 36 is coupled to the base 12 and the second end 38 of the serpentine shelf 36 is coupled to the second end 22 of the vertical support member 20. In this embodiment, to secure the serpentine shelf 36 to the base 12, the shelf 36 has a tab 39 that is sized to be received by a slot 35 in the base 12.

The display device 10 of the present invention supports itself while in the extend position by being carried by the vertical support member 20. Upon removing the vertical support member 20, the array of shelves 30 collapse on to themselves to a compact and flat condition.

The present disclosure includes that contained in the appended claims, as well as that of the foregoing description. Although this invention has been described in its preferred form with a certain degree of particularity, it should be understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. A collapsible display device for displaying cards comprising:

a base;

a vertical support member having a first and a second end, said first end coupled to said base and said vertical support member extending vertically from said base;

an array of tubular hoop rings longitudinally spaced along the length of said vertical support member and carried thereby, said array of tubular hoop rings being longitudinally collapsible to a position where said array of tubular hoop rings are substantially level with one another; and said tubular hoop rings having a retaining friction groove located on a lower edge on each of said tubular hoop rings for hol din g the cards upon the display device.

2. A collapsible display device for displaying cards comprising:

a base;

a vertical support member having a first and a second end, said first end coupled to said base and said vertical support member extending vertically from said base;

an array of longitudinally extensible shelves spaced longitudinally along the length of said vertical support member and carried thereby, said array of shelves being longitudinally collapsible to a position where said array of shelves are substantially level with one another;

each said shelf of said array of shelves has a side wall about the periphery of each said shelf of said array of shelves, said side walls being radially spaced from said vertical support member;

each said side wall having a flange extending radially outward from said side wall, said flange being parallel misaligned with each said shelf immediately below, and said shelf immediately below being supported by said flange of said shelf immediately above while the display device is extended; and securing means for retaining the cards on the display device, said securing means disposed upon said array of shelves such that the cards are displayed in a uniform manner from about the display device.

3. A collapsible display device for displaying cards comprising:

a base;

a vertical support member having a first and a second end, said first end coupled to said base and said vertical support member extending vertically from said base;

an array of longitudinally extensible shelves spaced longitudinally along the length of said vertical support member and carried thereby, said array of shelves being longitudinally collapsible to a position where said array of shelves are substantially level with one another;

each said shelf of said array of shelves having an inner side wall and an outer side wall about the periphery of each said shelf, said inner side wall and said outer side wall being displaced from one another to thereby define a card pocket for receiving the card, and said inner side wall and said outer side wall being radially spaced from said vertical support member.

4. The collapsible display device as claimed in claim 2 wherein said inner side wall and said outer side wall are coupled to one another with a spacer.

5. A collapsible display device for displaying cards comprising:

a base;

a vertical support member having a first and a second end, said first end coupled to said base and said vertical support member extending vertically from said base;

a serpentine support orbiting about said vertical support member, said serpentine support having a first end and a second end, said second end of said serpentine support coupled to said second end of said vertical support member and said first end of said serpentine support coupled to said base; and a plurality of aperture means through said serpentine support for receiving the cards on the display device, said plurality of aperture means disposed upon said serpentine support such that the cards are displayed in a uniform manner about the display device.

6. The collapsible display as claimed in claim 5 wherein said plurality of aperture means are vertical apertures disposed about said serpentine support.

7. The collapsible display as claimed in claim 5 wherein said plurality of aperture means are slanted apertures disposed about said serpentine support.

8. A collapsible display device for displaying cards comprising:

a base;

a vertical support member having a first and a second end, said first end coupled to said base and said vertical support member extending vertically from said base;

an array of longitudinally extensible shelves spaced longitudinally along the length of said vertical support member and carried thereby, said array of shelves being longitudinally collapsible to a position where said array of shelves are longitudinally level with one another, each said shelf of said array of shelves having a substantially vertical side wall about the periphery of each said shelf, said side walls being radially spaced from said vertical support member, each said side wall including a flange extending radially outward from said side wall, said flange of each said shelf of said array of shelves being parallel misaligned with each said shelf immediately below, and said shelf immediately below being supported by said flange of said shelf immediately above while the display device is extended; and a plurality of apertures through said array of shelves for retaining the cards on the display device, said plurality of apertures uniformly disposed upon said array of shelves.

* * * * *